United States Patent [19]

Mangal et al.

[11] 4,259,003

[45] Mar. 31, 1981

[54] IMAGING SURFACE DISCHARGE AND CLEANING APPARATUS FOR ELECTROPHOTOGRAPHIC COPIER

[75] Inventors: Norman F. Mangal; Ronald Swidler, both of Palo Alto, Calif.

[73] Assignee: Savin Corporation, Valhalla, N.Y.

[21] Appl. No.: 64,175

[22] Filed: Aug. 6, 1979

[51] Int. Cl.[3] ..... G03G 15/00; G03G 21/00

[52] U.S. Cl. ..... 355/3 CH; 118/652; 355/15; 361/212; 361/220

[58] Field of Search ..... 355/15, 3 R, 3 CH; 15/256.5, 256.51; 430/125; 361/212, 214, 220-222; 118/652

[56] References Cited

U.S. PATENT DOCUMENTS

| | | | |
|---|---|---|---|
| 3,484,237 | 12/1969 | Shattuck et al. | 430/80 |
| 3,884,572 | 5/1975 | Bacon et al. | 355/15 |
| 4,133,610 | 1/1979 | Bernardelli et al. | 355/3 CH |
| 4,165,172 | 8/1979 | Okamoto et al. | 355/15 |

*Primary Examiner*—Richard L. Moses

*Attorney, Agent, or Firm*—Shenier & O'Connor

[57] ABSTRACT

Apparatus for removing residual electrostatic charge following image transfer from the surface of a photoconductive imaging layer such as selenium exhibiting substantially greater dark resistance to the flow of current in one direction than in the other. A resilient conductive cleaning member in wiping engagement with the imaging layer and supplied with slightly conductive cleaning liquid is supplied with a biasing potential relative to the imaging layer substrate of a polarity opposite to that of the residual charge. The biasing potential is of such a magnitude as to ensure that all portions of the imaging layer surface have discharged to the potential of the substrate within the period of contact.

21 Claims, 6 Drawing Figures

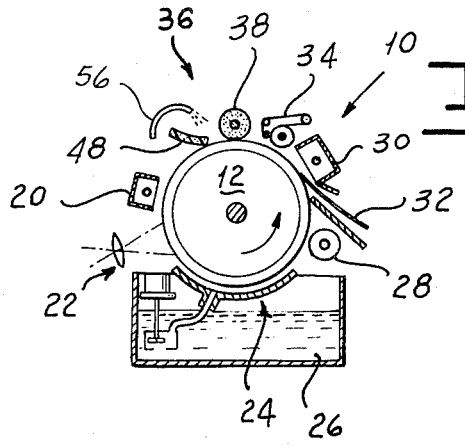
Fig 1
Fig 2
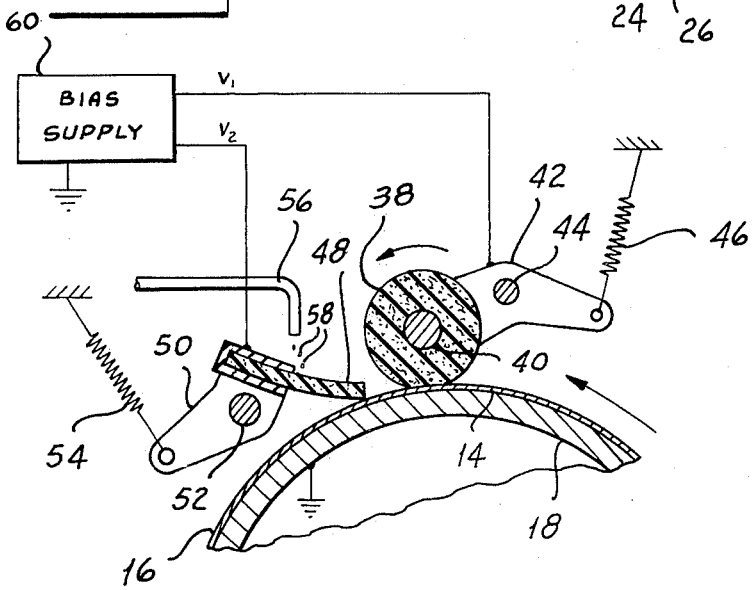
Fig 3
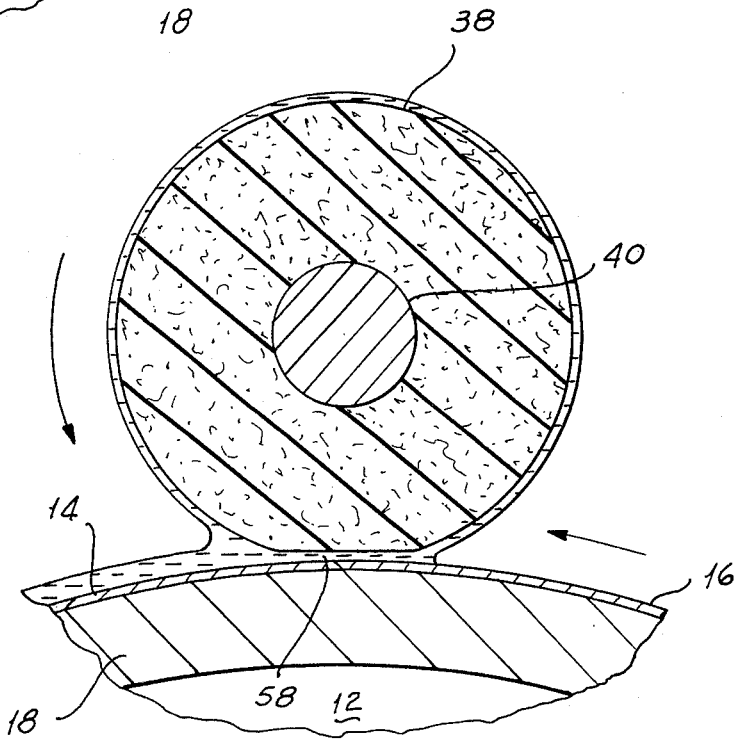

IMAGING SURFACE DISCHARGE AND CLEANING APPARATUS FOR ELECTROPHOTOGRAPHIC COPIER

BACKGROUND OF THE INVENTION

This invention relates to apparatus for concomitantly cleaning toner particles from and removing remaining electrostatic charge from the imaging surface of an electrophotographic copier following image transfer to a copy sheet.

In image-transfer, or plain paper, electrophotographic copiers, it is common to provide an AC discharge corona, quench lamp or similar device between the transfer station and charge corona to remove the latent electrostatic image remaining on the imaging surface after transfer of the developed image. Not only does such charge removal assist in the subsequent removal of toner particles from the imaging surface, but if left on the imaging surface, the original image may be superimposed on an electrostatic latent image formed later on the same imaging surface portion. Satomi U.S. Pat. No. 4,095,980 shows one such copier in which a discharge corona placed before the cleaning unit and a quench lamp placed after the cleaning unit are used to dissipate remaining electrostatic charge from the imaging drum.

While it is thus desirable to incorporate imaging surface discharge devices in an electrophotographic copier, such devices also have their drawbacks. Not only do these devices take up added space along the drum periphery, but they often draw an appreciable amount of power and thus generate heat which must be dissipated.

SUMMARY OF THE INVENTION

One of the objects of our invention is to provide an apparatus for dissipating remaining electrostatic charge on an electrophotographic imaging surface following image transfer.

Another object of our invention is to provide a discharge apparatus which is not bulky and which does not have excessive power requirements.

Still another object of our invention is to provide a discharge apparatus which operates reliably even after long periods of operation.

A further object of our invention is to provide a discharge apparatus which assists in the removal of remaining toner particles.

A still further object of our invention is to provide a discharge apparatus which is suitable for use in high-speed machines.

Another object of our invention is to provide an apparatus which effectively removes toner particles remaining on an imaging surface after image transfer without injuring the imaging surface.

Other and further objects of our invention will be apparent from the following description.

In general, our invention contemplates apparatus for removing residual electrostatic charge from the surface of a photoconductive imaging layer such as selenium exhibiting substantially greater dark resistance to the flow of current in one direction than in the other. A conductive member in engagement with the imaging layer is supplied with a biasing potential relative to the imaging layer substrate of a polarity opposite to that of the residual charge and of such a magnitude as to ensure that all portions of the imaging layer surface have discharged to the potential of the substrate within the period of contact.

In another aspect, our invention contemplates apparatus for removing electrostatic charge remaining on an electrophotographic imaging surface following image transfer in which a liquid layer having a certain relatively low bulk conductivity is provided on the imaging surface portion to be discharged, and a conductive member having substantially higher conductivity than the liquid layer is disposed adjacent to the imaging surface in electrical contact with the liquid layer to form an electrical path between differently charged areas of the imaging surface. Preferably the liquid layer comprises the carrier liquid commonly used to suspend toner particles in electrophotographic liquid developers, while the conductive member comprises one or more resilient cleaning elements contacting the imaging surface in the copier station. Preferably also the conductive member is connected electrically to the imaging surface substrate, either directly or through a biasing supply, to assist in equalizing charge and provide a return path for the equalized charge to the substrate.

BRIEF DESCRIPTION OF THE DRAWINGS

In the accompanying drawings which form part of the instant specification and are to be read in conjunction therewith and in which like reference numerals are used to indicate like parts in the various views:

FIG. 1 is a front elevation of an electrophotographic copier incorporating our discharge and cleaning apparatus.

FIG. 2 is an enlarged view of the cleaning station of the copier shown in FIG. 1, with additional parts shown.

FIG. 3 is a further enlarged view of the nip formed by the cleaning roller and the imaging surface in the cleaning station of the copier shown in FIG. 1.

DETAILED DESCRIPTION OF THE PREFERRED EMBODIMENT

Figure 4:
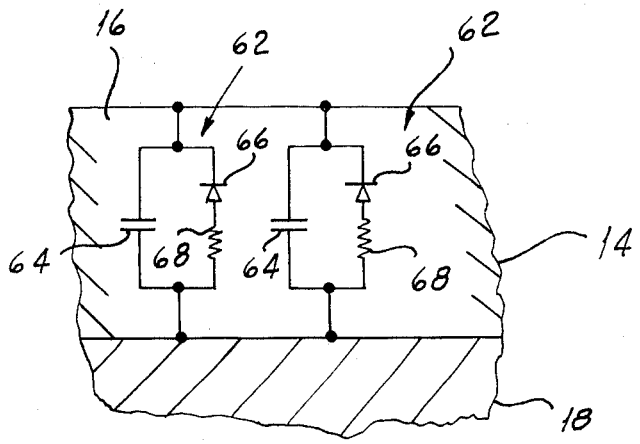
FIG. 4 is an enlarged view of the imaging layer of the photoconductive drum, showing its equivalent circuit when not illuminated.

Referring now to FIG. 1, a copier 10 incorporating our cleaning and discharge apparatus includes a cylindrical drum 12 having a photoconductive outer layer 14. Outer layer 14 has an exposed surface 16 on which an electrostatic latent image is formed. Layer 14 is formed on a grounded conductive substrate 18 in such a manner as to offer substantial dark resistance to positive current flow from the layer 14 to the substrate 18 while offering substantially less resistance to current flow in the opposite direction. Such a voltage-current characteristic is determined primarily by the choice of substrate 18 and its surface treatment, as is known to those skilled in the art. A discussion of some of the relevant considerations may be found in Dessauer and Clark, *Xerography and Related Processes* (New York: Focal Press, 1965), pp. 109–112.

Referring now to FIG. 4, insofar as its dark behavior is concerned layer 14 may be thought of as comprising a multiplicity of infinitesimally small areas, each of which has an equivalent circuit 62. Each equivalent circuit 62 comprises a capacitor 64 in parallel with a diode 66 and series-coupled resistor 68. Thus, positive charge placed on the surface 16 by a charging corona, for example, is "stored" in each of the elemental capacitors 64, and cannot leak off either through the associated resistor 68 or to the equivalent capacitor 66 of an adjacent area. A negative surface charge, on the other hand, will decay exponentially and eventually return to the substrate 18 through the respective resistors 68.

Referring again to FIG. 1, surface 16 is rotated by means not shown successively past a charging corona 20 which provides the surface 16 with a uniform positive electrostatic charge, an exposure station 22 at which the surface 16 is exposed to a light image of an original document (not shown) to selectively discharge the surface 16 to form a latent electrostatic image of the original, and a developing station 24 at which a liquid developer 26 containing negatively charged toner particles is applied to the drum surface 16 to form a developed toner image thereon. Thereafter the surface 16 moves past a closely spaced roller 28 which is driven at a high reverse velocity to remove excess developer liquid from the surface 16, then past an image transfer corona 30 under which the developed toner image is transferred to a copy sheet 32, leaving only residual portions of the developed image on the surface 16 as it leaves the transfer station. Finally, after the sheet 32 is separated from the surface 16 by means not shown to move through a turnaround assembly 34, the surface 16 moves through a cleaning station indicated generally by the reference numeral 36 in which the surface 16 is cleaned of the residual toner particles and, as will be further described below, is discharged in preparation for a subsequent copying cycle.

Referring now to FIGS. 2 and 3, upon entering the cleaning station 36, the drum surface first moves past a resilient, preferably closed-cell, open-surface-cell cleaning roller 38 carried by a shaft 40. Shaft 40 is rotatably received by bell cranks 42 which pivot around a pivot shaft 44 and are biased to move roller 38 in the direction of the drum surface 16 by a spring 46. Roller 38 is rotated by any suitable means (not shown) in a direction of surface movement opposite to that of the drum surface 16 at their point of contact to provide a scrubbing action. A conduit 56 supplies cleaning liquid 58, which may be identical to the liquid developer 26 used in the developing station 24, to the nip formed by roller 38 and drum surface 16 from the exit side of the nip. Next, the surface 16 passes a resilient, preferably noncellular cleaning blade 48 which wipes the surface 16 dry of loosened toner particles and cleaning liquid 58. Blade 48 is mounted in a yoke 50 rotatable about a pivot 52 and biased in the direction of drum surface 16 by a tension spring 54 or the like. Cleaning members 38 and 48 are supplied with biasing potentials $v_1$ and $v_2$ relative to substrate 18, opposite in polarity to that of the electrostatic charge image, from a supply 60 to assist in charge removal.

Preferably, the conductive material of which cleaning members 38 and 48 are formed is epichlorohydrin rubber, sold by B. F. Goodrich Co. under the trademark Hydrin 200 and by Hercules Chemical Co., Inc., under the trademark Herclor C. Not only is epichlorohydrin rubber highly compliant, thus allowing a relatively large "footprint" on the surface without excessive pressure or precision tolerances, but its conductivity is not adversely affected by exposure to electrophotographic developer liquids. In particular, the electrical properties of epichlorohydrin rubber are unaffected by exposure to the isoparaffin liquid, sold under the trademark Isopar G by the Exxon Corp., which we use for the developer liquid 26 and the cleaning liquid 58.

Another material found to work well, although not quite as well as epichlorohydrin rubber, is acrylic rubber, which has a resistivity of from $4\times10^6$ ohm-centimeters to $5\times10^8$ ohm-centimeters even with very little carbon loading. Other materials which may be used, though less suitable than epichlorohydrin or acrylic rubber, include neoprene or other synthetic materials heavily impregnated (e.g., 70% carbon for neoprene) with carbon to render them conductive. As a rule, however, these materials either are not as compliant as epichlorohydrin rubber or do not maintain their conductivity as well in the presence of isoparaffin developers.

Figure 5:
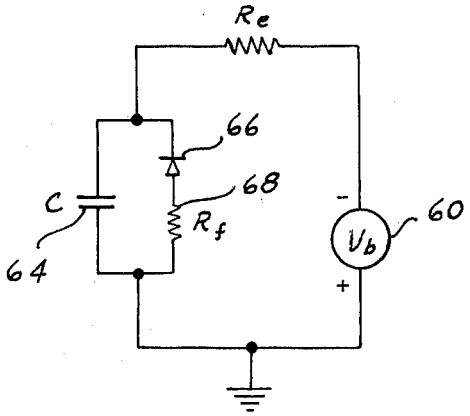
FIG. 5 is a schematic of the equivalent circuit formed by each of the incremental areas of the imaging layer when in electrical contact with a cleaning member.
Figure 6:
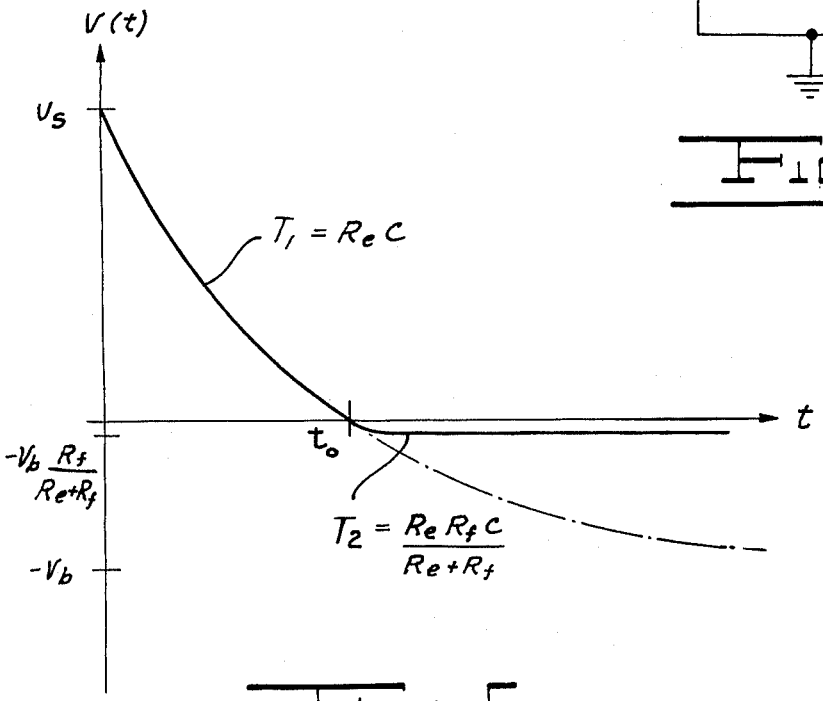
FIG. 6 is a plot of voltage versus time showing the decay of the surface charge on a portion of the imaging layer in electrical contact with a cleaning member.

Referring now to FIG. 5, which shows an equivalent circuit of the discharge path provided to each of the incremental areas of imaging layer 14 by the roller 38 or blade 48, initially it will be assumed that the upper surface 16 of the incremental area, which constitutes the upper plate of capacitor 64, is positively charged to a potential $v_s$ relative to the substrate 18 which constitutes the lower plate of capacitor 64. When the incremental area enters the nip formed by surface 16 with the cleaning member 38 or 48, it begins to discharge through the external path toward the level of the biasing potential $v_b$ as shown in FIG. 6 in accordance with the relationship:

$$v(t)=(v_s+v_b)e^{-t/R_eC}-v_b \quad (1)$$

where v(t) represents the potential of the incremental surface portion at a time t after it enters the nip, $R_e$ is the equivalent resistance of the cleaning member to current flow from a unit area of the surface 16, and C is the capacitance per unit area of layer 14.

When, at a time $t_0$, v(t) decays to such a point that it becomes negative, the equivalent diode 66 becomes in effect, forward biased, and resistor 68 becomes a part of the RC discharge circuit. Thereafter, as shown in FIG. 6, v(t) delays at a new exponential rate to a new limit value in accordance with the equation:

$$v(t)=-v_b[R_f/(R_e+R_f)][1-\exp(-(t-t_0)(R_e+R_f)/R_eR_fC)] \quad (2)$$

where $R_f$ is the forward resistance per unit area of layer 14. If $R_f$ is much smaller than $R_e$, as we have postulated, $R_f$ can be neglected and we can simply state that v(t) remains at zero after $t_0$.

From the above discussion, it will be apparent that the residual positive charge pattern on the surface 16 can be "erased" simply by ensuring that all areas have decayed to the point v=0, since the lower forward resistance of the layer 14 effectively prevents the surface from becoming negatively charged. This in turn is ensured by making the biasing potential sufficiently negative that the most positively charged area of surface 16 decays to zero potential within the period T during which it remains in the nip.

Assuming v(t) is zero and solving equation (1) for $v_b$, we obtain:

$$v_b-v_s/(e^{T/R_eC}-1) \quad (3)$$

The required biasing potential $v_b$ is thus proportional to the maximum initial surface potential $v_s$, and is lowered either by decreasing the external path resistance $R_e$, increasing the nip transit time as by lengthening the cleaning member "footprint," or both.

In the embodiment shown, for a blade 48 comprising neoprene heavily loaded with carbon to render it sufficiently conductive, a biasing potential $v_2$ of about minus 500 volts was required for complete erasure, owing to its relatively poor conductivity and contact with the surface 16. On the other hand, a blade 48 comprising epichlorohydrin rubber, being much more compliant and inherently more conductive than the neoprene blade, required a biasing potential of only about minus 100 volts for comparable performance. In either case the external power requirements are quite low, being about 20 milliwatts in the apparatus shown, as compared with about 3 watts for an AC discharge corona.

As these results demonstrate, there is a tradeoff between the conductivity of the conductive member 38 or 48 and the biasing potential required. It should be noted, however, that if the cleaning members 38 and 48 are too heavily loaded with carbon in an effort to render them conductive, they will have highly conductive hot spots, owing to practical manufacturing limitations. If at the same time a highly negative biasing potential is applied, the member will tend to grab the imaging surface at these hot spots, damaging and eventually destroying the imaging surface. For this reason, materials such as epichlorohydrin rubber which are inherently conductive are highly preferred.

In the above discussion, we have ignored the resistive effect of the liquid layer 58, since this layer cannot sustain more than a very small potential without experiencing breakdown. In a dry developer system, however, the equivalent gap will be filled with air, which requires a minimum potential of about 340 volts to achieve breakdown. In such systems, the magnitude $v_b$ of the biasing potential must be increased from the amount given in equation (3) by this breakdown potential.

If the bias supply 60 were eliminated and cleaning members 38 and 48 simply coupled directly to the substrate 18, the surface potential would simply decay exponentially, with a time constant of $R_eC$, to the breakdown potential of the liquid interface. Since this breakdown potential is much lower than the minimum potential on surface 16, which in practice is about 100 to 200 volts, the surface 16 would become effectively discharged, given a long enough period of contact T. Since in practice, however, these parameters cannot be arbitrarily selected without some cost, the use of an external biasing supply is highly preferred.

It is also possible to operate the copier 10 with the cleaning members 38 and 48 floating, in which case image erasure will still take place by means of conduction through the cleaning member from the more highly charged to the less highly charged areas of the imaging surface 16. In practice, however, coupling the cleaning member 38 or 48 electrically to the substrate 18 is highly preferable. Otherwise, a portion of imaging surface 16 is disposed across the cleaning nip will simply assume the average potential along that portion, resulting in a residual charge pattern of transverse waves.

Experiments have shown that our apparatus effectively removes unwanted charge from surface 16 without requiring a corona or a quench lamp. Further, since transfer of charge in our apparatus is relatively rapid and can be accelerated by increasing the biasing voltage, the speed at which the copier 10 may be operated is not limited by the rate of discharge. Our apparatus is thus especially adapted for use in high-speed machines.

Finally, the removal of uneven charge patterns from surface 16 in the cleaning station 36 decreases the attractive force between the untransferred toner particles and the surface 16, thus decreasing the mechanical force required to remove the particles from that surface. As a result, the roller 38 and blade 48 may be urged against surface 16 with lower pressures than those used for similar cleaning members in the prior art. This reduction in pressure significantly decreases the mechanical wear upon surface 16, greatly increasing its useful life. In fact, in experiments conducted with the embodiment shown in FIGS. 1 and 2, no visible wear of the drum surface 16 was evident even after 80,000 copies.

By "conductive" we do not mean an electrical conductivity of the order of that of metals and other materials commonly classified as conductors. For example, the epichlorohydrin rubber which is a preferred material for the conductive cleaning elements of our invention has an electrical resistivity of approximately $1.5\times10^8$ ohm-centimeters. Compared with most metals this is a very high resistivity, but it is sufficiently low to remove unwanted charge from surface 16 by conduction.

It will be seen that we have accomplished the objects of our invention. Our apparatus rapidly and effectively dissipates electrostatic charge remaining on an electrophotographic surface after image transfer without requiring additional space on the periphery of the surface. Our apparatus does not have appreciable power requirements, and operates reliably even after long periods of operation. Finally, our apparatus effectively removes toner particles remaining on the imaging surface after image transfer without injuring the surface.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In an electrophotographic copier having a photoconductor carried by a conductive substrate, means for forming an electrostatic latent image of a first polarity on the surface of said photoconductor, means for developing said latent image, and means for transferring a substantial portion of said developed image from said surface to a carrier sheet, said surface retaining a residual of the electrostatic charge of said latent image following transfer of said developed image, the improvement comprising means for disposing a conductive member adjacent to said surface in electrical contact therewith following said transfer, said photoconductor offering substantially less resistance to a surface charge of a second polarity opposite to said first polarity than said conductive member, and means for applying an electrical potential of said second polarity to said conductive member relative to said substrate, said photoconductor and said substrate being so formed that said photoconductor offers substantially less resistance to a surface charge of said second polarity than to a surface charge of said first polarity.

2. In an electrophotographic copier having a photoconductor carried by a conductive substrate, means for forming an electrically positive electrostatic latent image on the surface of said photoconductor, means for developing said latent image, and means for transferring a substantial portion of said developed image from said surface to a carrier sheet, said surface retaining a residual of the electrostatic charge of said latent image following transfer of said developed image, the improvement comprising means for disposing a conductive member adjacent to said surface in electrical contact therewith following said transfer and means for applying a negative electrical potential to said conductive member relative to said substrate, said photoconductor and said substrate being so formed that said photoconductor offers substantially less resistance to a negative surface charge than to a positive surface charge.

3. In an electrophotographic copier having a selenium photoconductor carried by a conductive substrate, means for forming an electrostatic latent image of a first polarity on the surface of said photoconductor, means for developing said latent image, and means for transferring a substantial portion of said developed image from said surface to a carrier sheet, said surface retaining a residual of the electrostatic charge of said latent image following transfer of said developed image, the improvement comprising means for disposing a conductive member adjacent to said surface in electrical contact therewith following said transfer and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

4. In an electrophotographic copier having a photoconductor carried by a conductive substrate, means for forming an electrostatic latent image of a first polarity on the surface of said photoconductor, means for developing said latent image, and means for transferring a substantial portion of said developed image from said surface to a carrier sheet, said surface retaining a residual of the electrostatic charge of said latent image following transfer of said developed image, the improvement comprising means for disposing a conductive member adjacent to said surface in electrical contact with each region thereof for a certain time interval following said transfer and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity, said potential being of such a magnitude as to ensure that all of said regions have discharged to the potential of said substrate within said time interval.

5. In an electrophotograhic copier having a photoconductor carried by a conductive substrate, means for forming an electrostatic latent image of a first polarity on the surface of said photoconductor, means for applying toner particles of a second polarity opposite to said first polarity to form a developed toner image on said photoconductor, and means for transferring a substantial portion of said developed image from said surface to a carrier sheet, said surface retaining residuals of the electrostatic charge of said latent image and of said toner particles of said second polarity following transfer of said developed image, the improvement comprising means for disposing a conductive member adjacent to said surface in electrical contact therewith following said transfer and means for applying an electrical potential of said second polarity to said conductive member relative to said substrate, said photoconductor and said substrate being so formed that said photoconductor offers substantially less resistance to a surface charge of said second polarity than to a surface charge of said first polarity.

6. In an electrophotographic copier having a photoconductor formed on a conductive substrate, means for forming an electrostatic latent image of a first polarity on the surface of said photoconductor, means for developing said latent image, and means for transferring a substantial portion of said developed image from said photoconductor to a carrier sheet, said surface moving successively along a recirculating path to said image-forming means, to said developing means, to said transferring means, and then again to said image-forming means, said surface retaining a residual of the electrostatic charge of said latent image following transfer of said developed image, the improvement comprising means for positioning a conductive member on said recirculating path between said transferring means and said image-forming means adjacent to said surface in electrical contact therewith and means for applying an electrical potential of a second polarity opposite to said first polarity to said member relative to said substrate, said photoconductor and said substrate being so formed that said photoconductor offers substantially less resistance to a surface charge of said second polarity than to a surface charge of said first polarity.

7. In an electrophotographic copier having a photoconductor formed on a conductive substrate, means for forming an electrostatic latent image of a first polarity on the surface of said photoconductor, means for developing said latent image, and means for transferring a substantial portion of said developed image from said photoconductor to a carrier sheet, said surface retaining a residual of the electrostatic charge of said latent image following transfer of said developed image, the improvement comprising means for positioning a conductive member adjacent to said surface in electrical contact therewith following said transfer and means for applying an electrical potential of a second polarity opposite to said first polarity to said member relative to said substrate, said photoconductor and said substrate being so formed that said photoconductor offers substantially less resistance to a surface charge of said second polarity than to a surface charge of said first polarity.

8. In an electrophotographic copier having a photoconductor positioned on a conductive substrate, means for forming an electrostatic latent image of a first polarity on the surface of said photoconductor, means for developing said latent image by an essentially insulating liquid developer having a certain bulk conductivity, and means for transferring a substantial portion of said developed image from said photoconductor to a carrier sheet, said surface retaining a residual of the electrostatic charge of said latent image, the improvement comprising means for positioning a conductive member having substantially higher conductivity than said liquid developer layer adjacent to said surface in electrical contact with said liquid developer following said transfer and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

9. In an electrophotographic copier having a photoconductor, means for forming an electrostatic latent image of a first polarity on said photoconductor, means for applying an essentially insulating liquid developer having a certain bulk conductivity to form a developed toner image on said photoconductor, and means for transferring a substantial portion of said toner image from said photoconductor to a carrier sheet, said surface moving successively along a recirculating path to said image-forming means, to said developing means, to said transferring means, and then again to said image-forming means, said photoconductor retaining a residual of the electrostatic charge of said latent image following transfer of said toner image, the improvement comprising means for disposing a conductive member having substantially higher conductivity than said liquid developer on said recirculating path between said transferring means and said image-forming means adjacent to said photoconductor in electrical contact with said liquid developer and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

10. In an electrophotographic copier having a photoconductor, means for forming an electrostatic latent image of a first polarity on said photoconductor, means for applying an essentially insulating liquid developer having a certain bulk conductivity to form a developed toner image on said photoconductor, and means for transferring a substantial portion of said toner image from said photoconductor to a carrier sheet, said photoconductor retaining a residual of the electrostatic charge of said latent image following transfer of said toner image, the improvement comprising means for disposing a conductive member having substantially higher conductivity than said liquid developer adjacent to said photoconductor in electrical contact with said liquid developer following said transfer and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

11. In an electrophotographic copier having a photoconductor carried by a conductive substrate, means for forming a latent electrostatic image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, a conductive member having substantially higher conductivity than said liquid layer positioned adjacent to said photoconductor in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

12. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor moving successively along a recirculating path to said image forming means, to said developing means, to said transferring means, and then again to said image-forming means, said photoconductor retaining a residual of the electrostatic charge of said latent image following transfer of said developed image, the improvement comprising means for providing an essentially insulating liquid layer having a certain bulk conductivity on said photoconductor, means for disposing a conductive member having substantially higher conductivity than said liquid layer on said recirculating path between said transferring means and said image-forming means adjacent to said photoconductor in electrical contact with said liquid layer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

13. In an electrophotographic copier having a photoconductor, means for forming an electrostatic latent image of a first polarity on said photoconductor, means for developing said latent image, means for transferring a substantial portion of said developed image from said photoconductor to a carrier sheet, and means for moving said photoconductor past said image-forming means, said developing means, and said transferring means, said photoconductor retaining a residual of the electrostatic charge of said latent image following transfer of said developed image, the improvement comprising means for providing an essentially insulating liquid layer having a certain bulk conductivity on said photoconductor, a resilient conductive member having substantially higher conductivity than said liquid layer, means for urging said conductive member against said photoconductor following said transfer with a sufficient force to create a region of adjacency with said photoconductor of appreciable extent in the direction of movement of said photoconductor and into electrical contact with said liquid layer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

14. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, means for disposing a conductive member having substantially higher conductivity than said liquid layer adjacent to said photoconductor in electrical contact with said liquid layer following said transfer, means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity, an elastomeric cleaning member, and means for positioning said cleaning member to engage the photoconductor.

15. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, means for disposing a resilient conductive blade having substantially higher conductivity than said liquid layer adjacent to said photoconductor in wiping engagement therewith and in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

16. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, means for disposing a resilient conductive roller having substantially higher conductivity than said liquid layer adjacent to said photoconductor in wiping engagement therewith and in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

17. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, means for disposing a conductive member having substantially higher conductivity than said liquid layer adjacent to said photoconductor in wiping engagement therewith and in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

18. In an electrophotographic copier having a photoconductor, means for forming an electrostatic latent image of a first polarity on said photoconductor, means for applying an essentially insulating developing liquid having a certain bulk conductivity to said photoconductor to develop said latent image, and means for transferring a substantial portion of said developed image from said photoconductor to a carrier sheet, said photoconductor retaining a residual of the electrostatic charge of said latent image following transfer of said developed image, the improvement comprising means for providing a layer of said developing liquid on said photoconductor, means for disposing a conductive member having substantially higher conductivity than said liquid layer adjacent to said photoconductor in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

19. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a resistivity of greater than $10^{10}$ ohm-centimeters on said photoconductor and means for disposing a conductive member having substantially lower resistivity than said liquid layer adjacent to said photoconductor in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

20. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge pattern of said latent image following transfer of said developed image, the improvement comprising means for providing an essentially insulating liquid layer having a certain bulk conductivity on said photoconductor, means for disposing a conductive member having substantially higher conductivity than said liquid layer adjacent to said photoconductor in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity, the respective conductivities of said liquid layer and said conductive member being such as to permit substantial equalization of said electrostatic charge pattern in the presence of said member and prevent such equalization in the absence of said member.

21. In an electrophotographic copier having a photoconductor, means for forming an electrostatic latent image of a first polarity on said photoconductor, means for developing said latent image, and means for transferring a substantial portion of said developed image from said photoconductor to a carrier sheet, said photoconductor retaining a residual of the electrostatic charge of said latent image following transfer of said developed image, the improvement comprising means for providing an essentially insulating liquid layer having a certain bulk conductivity on said photoconductor, means for disposing a conductive member having substantially higher conductivity than said liquid layer adjacent to said photoconductor in electrical contact with said liquid layer following said transfer, and means for applying an electrical potential of a second polarity opposite to said first polarity to said conductive member relative to said substrate, said photoconductor and said substrate being so formed that said photoconductor offers substantially less resistance to a surface charge of said second polarity than to a surface charge of said first polarity.

* * * * *